US009339114B2

(12) United States Patent
Strolka-Echols et al.

(10) Patent No.: US 9,339,114 B2
(45) Date of Patent: May 17, 2016

(54) ELECTRIC OUTDOOR LOUNGE CHAIR

(76) Inventors: Johanna Strolka-Echols, Ahlerstedt (DE); Deloyise Echols, Ahlerstedt (DE)

( * ) Notice: Subject to any disclaimer, the term of this patent is extended or adjusted under 35 U.S.C. 154(b) by 66 days.

(21) Appl. No.: 13/504,301

(22) PCT Filed: Nov. 10, 2010

(86) PCT No.: PCT/EP2010/006840

§ 371 (c)(1),
(2), (4) Date: Apr. 26, 2012

(87) PCT Pub. No.: WO2011/057772

PCT Pub. Date: May 19, 2011

(65) Prior Publication Data

US 2012/0205951 A1 Aug. 16, 2012

(30) Foreign Application Priority Data

Nov. 10, 2009 (DE) ..... 10 2009 052 396

(51) Int. Cl.
*A47C 1/14* (2006.01)
*A47C 20/04* (2006.01)
*A47C 21/06* (2006.01)

(52) U.S. Cl.
CPC ..... *A47C 1/143* (2013.01); *A47C 20/041* (2013.01); *A47C 21/06* (2013.01)

(58) Field of Classification Search
CPC ..... A47C 1/143; A47C 20/041; A47C 21/06
USPC ..... 297/217.3
See application file for complete search history.

(56) References Cited

U.S. PATENT DOCUMENTS

| | | | | | |
|---|---|---|---|---|---|
| 4,188,677 | A | * | 2/1980 | Zur | 5/615 |
| 4,379,588 | A | * | 4/1983 | Speice | 297/217.3 |
| 4,597,119 | A | * | 7/1986 | Padgett | 5/656 |
| 4,856,520 | A | * | 8/1989 | Bilicki | 607/95 |
| 4,933,618 | A | * | 6/1990 | Ortlieb | 318/640 |
| 5,159,191 | A | * | 10/1992 | Mankovitz | 250/229 |
| 5,211,172 | A | * | 5/1993 | McGuane et al. | 607/95 |
| 5,395,157 | A | * | 3/1995 | Rollo et al. | 297/344.26 |
| 5,564,784 | A | * | 10/1996 | Felling | 297/344.23 |
| 5,893,608 | A | * | 4/1999 | Cravenor | 297/217.3 |
| 5,897,163 | A | * | 4/1999 | Singer | 297/217.7 |
| 5,944,384 | A | * | 8/1999 | Patterson | 297/344.23 |
| 5,975,630 | A | | 11/1999 | Schreiber | |
| 6,000,353 | A | * | 12/1999 | De Leu | 114/61.1 |

(Continued)

FOREIGN PATENT DOCUMENTS

| | | |
|---|---|---|
| CN | 101 355 266 | 1/2009 |
| DE | 36 11 544 | 10/1987 |

(Continued)

*Primary Examiner* — David R Dunn
*Assistant Examiner* — Tania Abraham
(74) *Attorney, Agent, or Firm* — Fay Kaplun & Marcin, LLP

(57) ABSTRACT

A lounger includes at least a weatherproof base frame, a weatherproof lounger frame with at least two movably mounted lounger frame elements, and at least one weatherproof drive unit for supplying at least one drive device with electric energy. The drive unit preferably includes a combination of an accumulator, a solar cell, and a grid connection, and contributes in connection with a weatherproof design of the frames to portable and grid-power-independent lounger with an automatic adjusting functionality.

17 Claims, 3 Drawing Sheets

(56) References Cited

U.S. PATENT DOCUMENTS

| | | | | |
|---|---|---|---|---|
| 6,882,162 | B2 * | 4/2005 | Schirmer | B60R 21/01554 297/217.3 |
| 7,025,418 | B1 * | 4/2006 | Hackal | 297/217.3 |
| 7,931,334 | B1 * | 4/2011 | Caruso | 297/217.3 |
| 8,061,864 | B2 * | 11/2011 | Metcalf et al. | 362/127 |
| 8,091,960 | B2 * | 1/2012 | Kincaid | A47C 7/748 219/202 |
| 8,203,657 | B2 * | 6/2012 | Vitito | B60K 35/00 297/217.3 |
| 2001/0000419 | A1 * | 4/2001 | Heilig | B60N 2/427 297/410 |
| 2005/0099043 | A1 * | 5/2005 | Kim | B60N 2/5685 297/217.3 |
| 2007/0152477 | A1 | 7/2007 | Schneider et al. | |
| 2009/0251106 | A1 | 10/2009 | Samstad | |
| 2010/0290215 | A1 * | 11/2010 | Metcalf et al. | 362/127 |

FOREIGN PATENT DOCUMENTS

| | | |
|---|---|---|
| DE | 44 04 330 | 8/1994 |
| DE | 295 13 621 | 12/1995 |
| DE | 203 14 184 | 11/2003 |
| DE | 203 14 184 | 12/2003 |
| DE | 20 2004 014101 | 11/2004 |
| DE | 20 2004 014 101 | 12/2004 |
| DE | 20 2004 011 096 | 12/2005 |
| DE | 20 2008 003 844 | 8/2008 |
| FR | 2 846 208 | 4/2004 |

* cited by examiner

ELECTRIC OUTDOOR LOUNGE CHAIR

RELATED APPLICATIONS

This application is a national phase entry of International Application No. PCT/EP2010/006840, filed Nov. 10, 2010 published in German, which claims the benefit of German Patent Application No. 10 2009 052 396.0 filed Nov. 10, 2009, the disclosure of which is hereby incorporated herein by reference.

FIELD OF THE INVENTION

The invention relates to a lounger and to a drive unit for a lounger.

TECHNOLOGICAL BACKGROUND

In large and small gardens throughout the world, on boats and ships, seating and lounge furniture are commonly used and are offered in different variations. For example, seating furniture designed for garden use and consisting of plastics netting and water-repellent cushioning exist, which seating furniture is barely distinguishable from common seating furniture for indoor use.

Besides that, there also exist relatively classic sun loungers, which comprise a large backrest and a foot part whose angle may be changed in steps, such that sitting or lying in several positions may be provided. The simplest models are comprised of a wooden frame with several frame parts which are movably mounted to each other, such that for example one frame part may be inserted or attached in recesses of another frame part for adapting the sitting or lying angle. Similarly, also sun loungers are known which are made of a frame of hollow profiles of aluminium or the like, and which have armrests which may be locked in different positions on a base structure and which, depending on the locking position, define an angle of the backrest. In such furniture, the movement of the foot part may often be coupled to the movement of the back part.

The described known furniture for use in the garden have a number of technical features that enhance the comfort of the sitting or lying person, however they also have several distinct disadvantages. For example, if a person is situated on a classic sun lounger described above and if this person likes to change the position, from a sitting to a lying position or vice versa, he often has to get up from the sun lounger for disengaging the locking of the back part from a position behind the backrest and re-establishing the locking at another position, or the person has at least to lean forward to remove the weight from backrest, such that with the help of the arm rests or the like, an adjusting of the sitting or lying angle may take place. This may be particularly disadvantageous, if the person under good weather conditions decides to sleep on the sun lounger, at the same time the standing up or the shifting of weight for adjusting the sitting or lying angle reduces the tiredness, such that falling asleep may be delayed or prevented, or the person has to sleep in a position uncomfortable for the person. Also for senior persons it may be exhausting to get up from a lying position into a sitting position without shifting the weight onto the backrest, or laboriously to adjust the angle of the back element.

In the state of the art, lying furniture is known which particularly enhance the comfort for senior persons, for example in hospitals or for domestic care, however, this furniture is adapted exclusively for the use in dry rooms and is not suited for use in a garden. Furthermore, it would be relatively inconvenient to have to provide a power supply in the garden for operating such known lying furniture during good and dry weather in the garden.

SUMMARY OF THE INVENTION

Thus, there may be a need for a lounger which provides a lying and seating opportunity which is as comfortable as possible, wherein adjusting of the sitting or lying position is feasible as simple as possible, without the necessity of getting up or of load removal of a back element, or the like. The term of the lounger is not to be construed as limiting, but can at the same time encompass lying furniture for the use on ships or boats.

At the same time, there may be a need for a lounger which may be operated as comfortable as possible, which however may be robust against external influences and which may be portable.

According to a first aspect of the invention, the lounger according to the invention comprises a base frame, a lounger frame, and a drive unit. In the following, a base frame denotes a support or another frame-like structure which defines the outer shape of the lounger. Accordingly, a substantially rectangular-shaped structure may be used as a base frame, which structure may be adapted for being placed on a floor and for receiving a lounger frame which allows seating or lying on the lounger according to the invention.

Basically, the lounger frame may be constructed using several lounger frame elements which may be movably connected with each other, and which for example should allow sitting and lying positions of a person situated thereon. In the simplest case, the lounger frame may be designed in the form of an adjustable slatted frame or the like, and for example comprise a foot part and a back part.

The drive unit may be understood as a compact unit which may be adapted for providing for an energy supply for an automatic adjustment of the lounger elements. Therein, the invention is not confined to a certain functional principle, it may be quite possible to employ several different functional principles for providing a sufficient energy supply.

According to an embodiment the invention may be seen in designing the construction of base frame, lounger frame, and drive unit in such a way that an operation may be possible independent from an external electric power supply and such that a weather resistance is ensured. This implies on the one hand, that the base frame may be produced with a weatherproof material. For example, this may be a thermoplastic material, a duromer material, a fiber composite material, a weatherproof metallic material such as for example aluminium, anodized aluminium, steel with a corresponding galvanization, stainless steel, or the like, wherein also pressure-impregnated wood or other weatherproof materials may be considered.

The lounger frame may also be comprised of one of the materials mentioned above, wherein several different materials may be used for both frames at the same time. The several lounger frame elements may preferably be connected with each other by way of hinge joints, wherein the hinge joints may be produced of plastics, metal, a combination of plastics and metal, and the like.

In the conception of the material composition, a point should be made of choosing plastics which may particularly be UV-proof. As may be often seen in particular in the state of the art, plastics garden furniture may become brittle and fragile after a period of time in which they are exposed to solar radiation, and after which they may not be used any more. A particularly good UV-resistance may be achieved by polymethyl methacrylate, polycarbonate and polyvinylidene fluoride.

The lounger frame may preferably be designed as a kind of slatted frame, wherein the different lounger frame elements may be movable by way of one or several drive devices. For example, a lounger frame element may be provided in the form of a foot element, which may be moved in parallel to the base frame by a drive device. This may, for example, be realized by a kind of parallelogram guide, in which two levers which are mounted in parallel to each other at the base frame, guide the foot part. The foot part may be moved in parallel to the base frame by pivoting one of these levers by way of a drive device or by deflecting a hinge point at the foot part. However, the invention may not be limited to actually pivot single elements of the lounger elements, thus the parallel guiding of the foot part to the base frame should not be construed as a limitation. In fact, any kind of movable or deformable lounger frame which may be realized with one or several areas, for example with so-called multi-zone slatted frames or the like, and which enhance the comfort of a user, may be possible.

A drive device for moving the lounger frame or individual lounger frame elements may according to the invention be designed waterproof and weatherproof. This may for example imply that the drive device may completely be encapsulated, for example by a rubber bellows. The functionality of such a drive device may be that two ends of the drive device move towards or away from each other, and by way of this contraction or expansion, two defined hinge points of the lounger frame move away or towards each other.

In this way, in the example mentioned above, a rodding of the foot part may be extended by the parallelogram guide and at the extended end of the foot part, a drive device may be fastened, which drive device may be mounted with its other end at a fixed point of the base frame. A movement of the foot part may be forced by the expansion or contraction.

A complete enclosure of the drive device exclusively results in a protection for a possible spindle drive or any other linear drive against external effects such as rain, snow, dust, sand, or dirt. The connection of a drive device to the drive unit may be realized by a cable which at the connection to the drive device may be grouted, welded, or connected in any other way to the rubber bellows.

The drive unit may be understood as a compact, closed unit which provides the drive devices with sufficient electricity. With a combination of an accumulator, a solar cell, a charging device, a voltage transformer, and a control unit, a possibility may be suggested for providing a sufficient energy supply to one or several drive devices independently of an electric power supply, such that the lounger according to the invention may be placed at any place within a garden, without being dependent on a socket outlet and cables.

By combining the features mentioned above, a lounger is suggested which may be particularly robust against environmental influences and at the same time may provide a maximum in convenience for a user. A lounger frame may meet different needs of users in that different heights and angles of lounger frame elements may be adjusted. An encapsulation of the drive device for the lounger frame and an electric power supply independent from a grid serve for enhancing the comfort, while at the same time rainproof and weatherproof materials may be used.

According to an advantageous embodiment of the lounger according to the invention, the lounger frame comprises several lounger frame areas which may be adjusted independently from each other by way of one or several drive devices. The adapting may comprise adjusting of a height, an angle and a distance, furthermore it may comprise an adjustment of a hardness, or the like. Thus, the comfort of a user may be adjusted depending on the number of areas very individually.

According to a further similarly advantageous embodiment of the lounger according to the invention, the lounger frame may be adapted for receiving a lounger overlay, such that the comfort of the user may be chosen depending on his liking in that an individual lounger overlay may be used.

According to a similarly advantageous embodiment of the lounger according to the invention, the lounger overlay may be realized as a mattress, which for example may be produced of a foam, and which depending the number, position and size of the lounger frame elements, may be adapted for not obstructing a bending of the lounger frame.

According to a particularly preferred embodiment, the lounger overlay may be designed such that the lateral surfaces and the upper side may be manufactured from a water-repellent material, which should be as UV-proof as possible. The upper side and the lateral surfaces of the lounger overlay may comprise more than one material, wherein an upper material for example should comprise particularly optical and haptic qualities, which a user of seating and lying furniture for the garden may expect, while a layer positioned below the upper layer may be primarily used for repelling water. The lower side of the lounger overlay should preferably be designed from a material which may be water-repellent and at the same time may be breathable. If the mattress is manufactured from a foamed material, a particularly good compression movement may be allowed, at the same time, sweat or condensed water which entered through small cracks, seams, or the like may escape from the lounger overlay, thus enhancing its durability.

It is also preferable, that the lounger overlay is manufactured in form of a self-inflating mattress, which in its shape may also be adapted to the individual areas of the lounger frame, such that a movement of the lounger frame may not be obstructed. For this purpose, the lounger overlay should all-around be designed from a water-repellent material, which may be designed airtight and at the same time breathable at least at the lower side. If a relatively soft foam core is chosen for the self-inflating function, it may be appropriate to design the entire lounger overlay completely airtight and waterproof. The entry of air into the lounger overlay may be made possible by a corresponding manually closable ventilation opening.

It might also be preferable to design a lounger overlay in form of an inflatable mattress which comprises a ventilation connection and a vent connection which may be connected to a compressor, which compressor may for example be arranged at the drive unit. In this way, a user may be able to remove the lounger overlay during winter months, and to store it space-savingly in the house. On the other hand, in this way at the same time the possibility may be provided to adjust the hardness of the lounger overlay according to the liking of a user, such that in cooperation with several lounger frame elements and lounger frame areas, a particularly good adaptability to the needs of a user may be realized.

At the same time, it may be particularly preferable to provide a receiving compartment within the base frame which may be used for accommodating the drive unit. Thus, it may not be absolutely necessary to provide a separate container or the like beside or behind the inventive lounger, in which the drive unit is to be placed.

At the same time, it may also be preferable to provide one end of the inventive lounger with two wheels which may be used for moving the lounger in the garden. For example, one end of the lounger may comprise only feet, while the opposing end comprises two wheels. By way of lifting the end with the feet, a simple moving of the inventive lounger may be possible.

According to a preferred embodiment of the lounger according to the invention, the drive unit may be designed as a separate component which may provide an electric power supply for enhancing the functionality of several different components. In addition to an accumulator, which may be charged manually by way of an integrated charging electronics, a solar cell may be arranged at an upper side of the drive unit, which solar cell in particular during good weather, that is, when a use of the lounger is to be expected, makes possible a recharging or a maintaining of the charge of the accumulator, or a providing of electric energy. Also for this purpose, a dedicated charging electronics may be necessary, which may also be combined with the charging electronics which effects a charging of the accumulator with grid electricity.

At the same time, a separate independent drive unit may be adapted for forming a connection with a connection device of the lounger according to the invention. Preferably, an individual connection device or a combined connection device may be necessary for each drive device, and thus particularly for each lounger frame area to be adjusted, which connection device makes possible a connecting of several electrical circuits between the drive unit and several drive devices.

In this way, it may be ensured that a controlling of the lounger according to the invention may be carried out by the drive unit itself, as for example by way of a remote control which may be coupled to the drive unit wirelessly or wire-based. By providing an electrical circuit between the drive unit and the drive device, a drive device may be put into operation, such that a corresponding lounger frame element may be moved.

Accordingly, it would be possible to remove the drive unit together with the electronics and the accumulator from the lounger according to the invention, and to store it in the house, despite the weatherproof design. This may be particularly advantageous for the electronics and the accumulator, whose functionality otherwise may be compromised at low temperatures. At the same time, the removability of the drive unit serves as protection against contamination, particularly during autumn or winter weather.

The connecting device may be realized in various ways. If, for example, the drive unit is arranged in the receiving compartment described above in the base frame of the lounger according to the invention, a conventional electrical plug connection may be completely sufficient, as the plug connection in the receiving compartment or the like is relatively well protected within the base frame and below the lying surface, and which should not get wet, also during heavy rain. On the other hand, an inductive electrical connection between the drive unit and the individual drive devices may be created, so that it may be only necessary to provide the drive unit with induction coils, preferably with core elements, which correspond to induction coils with core elements at the lounger according to the invention, and in this way transmit electricity. In this way, the drive unit as well as the connection device directly at the lounger according to the invention may be encapsulated.

Furthermore, it may be particularly advantageous to provide the drive unit with additional interfaces, such that for example a charging of the accumulator may be possible, without prior opening or disassembling of the drive unit. As an example, the power connection socket is mentioned here, which may be made weatherproof by way of the sealed screw top. Therein, the screw top may be manufactured from a metallic material, which does not become brittle due to external environmental influences, wherein at the inner surface of the screw top, a sealing ring may be arranged, which sealing ring makes possible a particularly good sealing of the power connection plug.

Similarly, it may be conceivable, to provide further interfaces which may allow a user to operate electronic devices, particularly during good weather. As an example, a low voltage connection is mentioned here, which may, for example be designed as an USB-connection for modern portable electronic devices. This connection may also be encapsulated by way of a screw top or the like, wherein the screw top may be removed by a user when required, to make possible a use of the USB connection. In this way, mobile phones, MP3 players, or the like may be used over a considerably prolonged time period.

For a better usability of the lounger according to the invention on board of ships or boats, the frame should be produced of a material which may be extremely durable, also when constantly being subjected to moisture and salted water. This material may a metallic material, as for example steel or aluminium, which may be provided with a saltwater proof priming and/or finishing. At the same time, also various kinds of wood may be suitable for a use on board of ships, which preferably are treated with such primings and/or finishings. Basically, it may be appropriate to use quite robust kinds of wood, which additionally may be provided with a clear, shiny, robust, and saltwater-resistant finishing layer for all of the considered climate regions.

For the use on ships, it may be advantageous to adapt the choice of material, and thus the weight of the lounger to the size and kind of ship. When used on bigger cruise ships, relatively heavy loungers which comprise a steel frame or a solid wood frame may be used, thus preventing an easy slipping on deck. This may be further enhanced by providing a rubber coating or another slip-proof coating at areas of the lounger which contact the floor of the ship. On board of smaller boats, which for example have clearer weight limitations, lighter frame constructions may be appropriate, for example using hollow profiles from aluminium.

Additionally, it may be appropriate to enhance the weather protection of the drive unit and of the drive device for use on board of ships in such a way that all joint patches of a housing of the drive unit may be packed and sealed, and in that radial sealings of the drive device are adjusted for use in a surrounding comprising saltwater. Additionally, it may be advantageous to produce moveable elements of a drive device from aluminium or stainless steel, and/or to coat the moveable elements completely with a bellows construction, for minimizing the risk of rusting.

In a particularly advantageous embodiment of the lounger according to the invention, the drive unit which provides energy may be adapted for providing energy to several drive devices of several loungers. This implies that, for example on deck of a cruise ship, large numbers of loungers according to the invention may be connected to a common drive unit, which provides all of the loungers coupled to it with energy with the help of available energy sources, such as an onboard power grid, solar energy, an accumulator, or the like. This system of loungers accordingly comprises a common drive unit with several drive devices of several loungers coupled to the drive unit. For example, a drive unit may provide energy to 10-50 loungers.

The need mentioned above may be also met by the already described drive unit. At the same time, a use of a drive unit according to the invention for driving of an electrical lounger may also cover the need.

BRIEF DESCRIPTION OF THE DRAWINGS

Further features, advantages, and application possibilities of the present invention may be derived from the following description of embodiments and from the figures. Therein, the described and depicted features form the subject-matter of the invention separately and in any combination, independently from their combination in the individual claims or their back references. Furthermore, in the figures same reference numbers are used for same or similar objects.

DETAILED DESCRIPTION OF EXEMPLARY EMBODIMENTS

Figure 1:
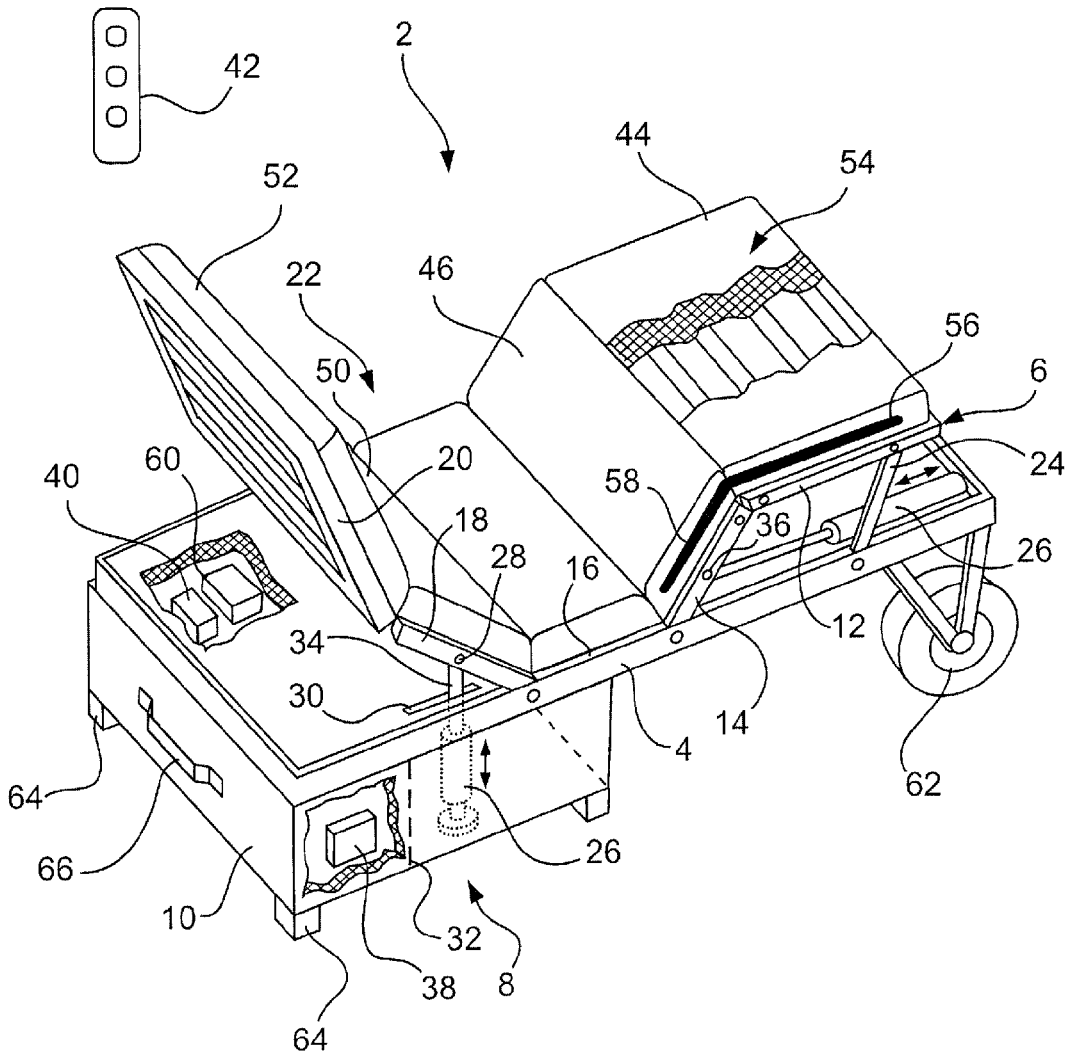
FIG. 1 shows a view of a first embodiment of a lounger according to the invention.

In FIG. 1, an embodiment of a lounger 2 according to the invention is shown exemplarily, the lounger 2 exemplarily comprises a base frame 4, a lounger frame 6, and a drive unit 8, which may be arranged in a receiving compartment 10 below the base frame 4. The lounger frame 6 may exemplarily be divided into five different areas 12-20 on which a lounger overlay 22 is arranged.

Exemplarily, a foot part formed by the lowest lounger frame area 12 may be lifted in parallel to the base frame 4, wherein the parallel guidance may be provided by a lever 24 which is arranged in parallel to the lounger surface area 14. The movement of the foot part may be realized by a drive device 26 which moves the area 14 of the lounger frame at a point 36, and which alternatively may also deflect the lever 24. The invention is not to be limited thereto. Furthermore, a deflection direction of the drive device 26 should not be construed as a limitation of the invention. Rather, the shown example makes clear, that a lounger 2 may be provided which may absolutely flexibly be adapted to individual user needs for enhancing the comfort of the user.

Furthermore, it may be possible to move a lounger frame area 18 or 20 by way of a further drive device 34, which engages the lounger frame element 18 at a point 28. This point 28 is chosen absolutely arbitrarily in the shown presentation, the invention is not to be limited thereto.

In the shown embodiment, a weather protection for the drive devices 26 and 34 may be provided in that the drive device 34 is arranged in a receiving compartment 10 and is only in contact with the surroundings by way of a slot 30. This slot may be furthermore protected by a blind-like device which encloses the drive device 34 on both sides, and which may be movable within the slot 30. At the same time, also the receiving compartment 10 may be designed shorter, wherein it may extend up to the dashed line 32, such that the drive device 34 would have to be mounted at another point, and would then be completely exposed to the surroundings. Here, it may be appropriate to put a rubber bellows or the like at the drive device 34, which rubber bellows provides for a complete encapsulation of the drive device 34. Analogously, the same may be possible for the drive device 26.

Within the receiving compartment 10, in other words within the drive unit 8, exemplarily an accumulator 38 may be arranged, which accumulator is connected to an electronics unit 40. This electronics unit may be adapted for converting inputs of a remote control 42 into a current flow from an accumulator 38 or from another current source to the driving devices 26 and 34. At the same time, the electronics unit 14 may be adapted for making possible a charging or a charge maintaining of the accumulator 38.

In the shown case, the lounger overlay 22 may also be designed with five areas 44-52, which may be adapted to the lounger frame areas 12-20. In this way, an easy movability may be provided. For example, the lounger overlay 22 may be provided as an integrally formed component which may be pivoted easily due to recesses or cut-outs in the bending positions.

The lounger overlay 22 may be any kind of lounger overlay. Conventional mattress structures which for example may be formed of a foamed material may be possible. At the same time, also a self-inflating mattress may be possible which for example comprises an airtight casing 54, and which may be supplied with pressurized air by way of a pressurized air connection. It may be possible to attach a pressurized air line 58 to the pressurized air connection 56, and to connect the pressurized air line to the compressor 60 within the drive unit 8. In this way, a user may be able, for example by operating a remote control 42 or the like not only to adjust the location or position of the individual lounger frame elements 12-20, but also to adjust the fill level of the lounger overlay 22, and in this way to obtain a further degree of freedom for adjusting the personal convenience.

Basically, it may be possible to design the lounger 2 according to the invention also transportable, which in the shown embodiments may be achieved by way of a pair of wheels 62, which for example may be arranged below a foot end of the lounger. At an opposing end, the lounger 2 according to the invention rests for example on two feet 64, and further comprises a handle 66 which serves for lifting the lounger 2 according to the invention at one side, such that the lounger 2 may be moved on a ground by way of the wheels 62.

Figure 2:
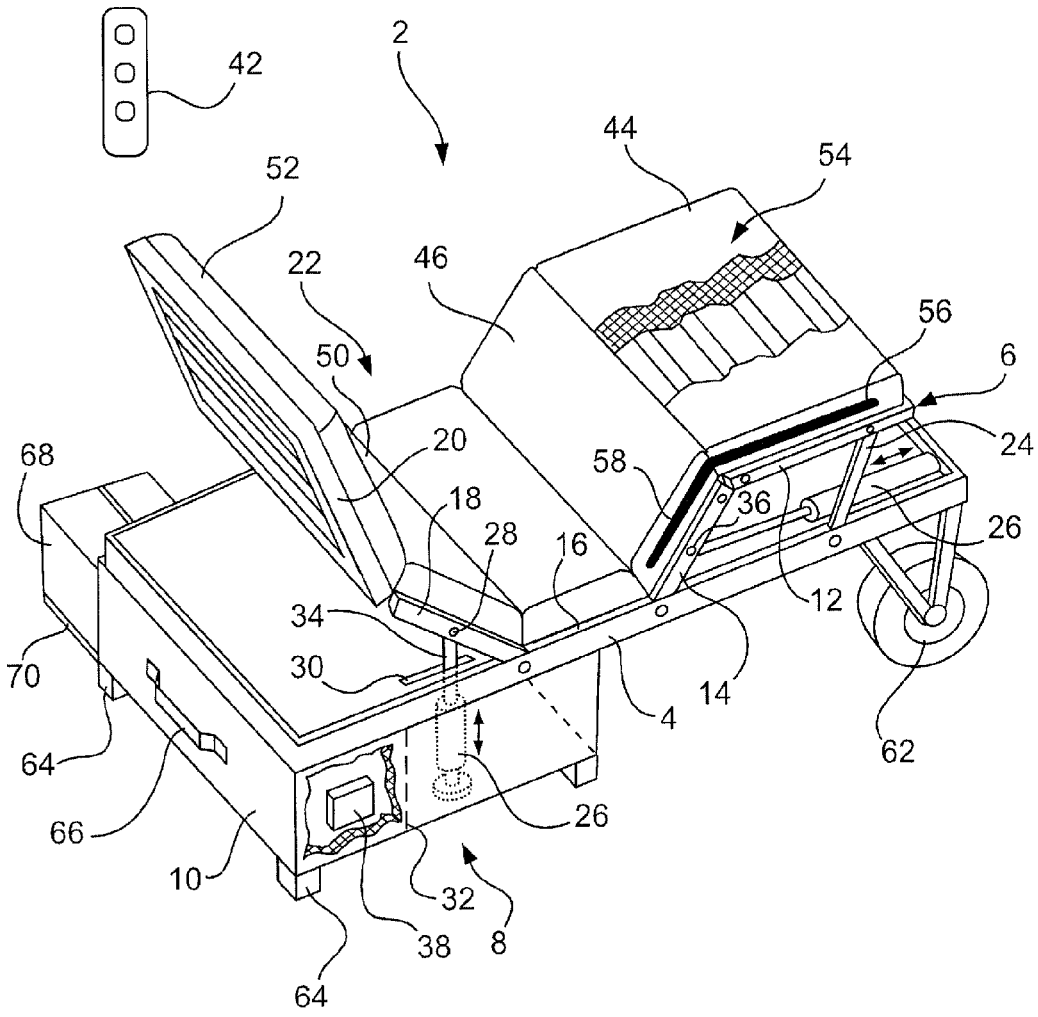
FIG. 2 shows a view of further embodiment of a lounger according to the invention.

In the shown embodiment of FIG. 1, the drive unit 8, which coordinates the current supply and the connection to a control element, for example in the form of a remote control 42, may be arranged in a receiving compartment 10 below the base frame 4. It may however also be possible to conceive or to provide a drive unit which is designed as a completely separate component, and which may be mounted to a lounger according to the invention manually. This is shown in FIG. 2, where a drive unit 68 is arranged at a base 70, and which supplies sufficient electric current to the lounger 2 according to the invention.

Figure 3:
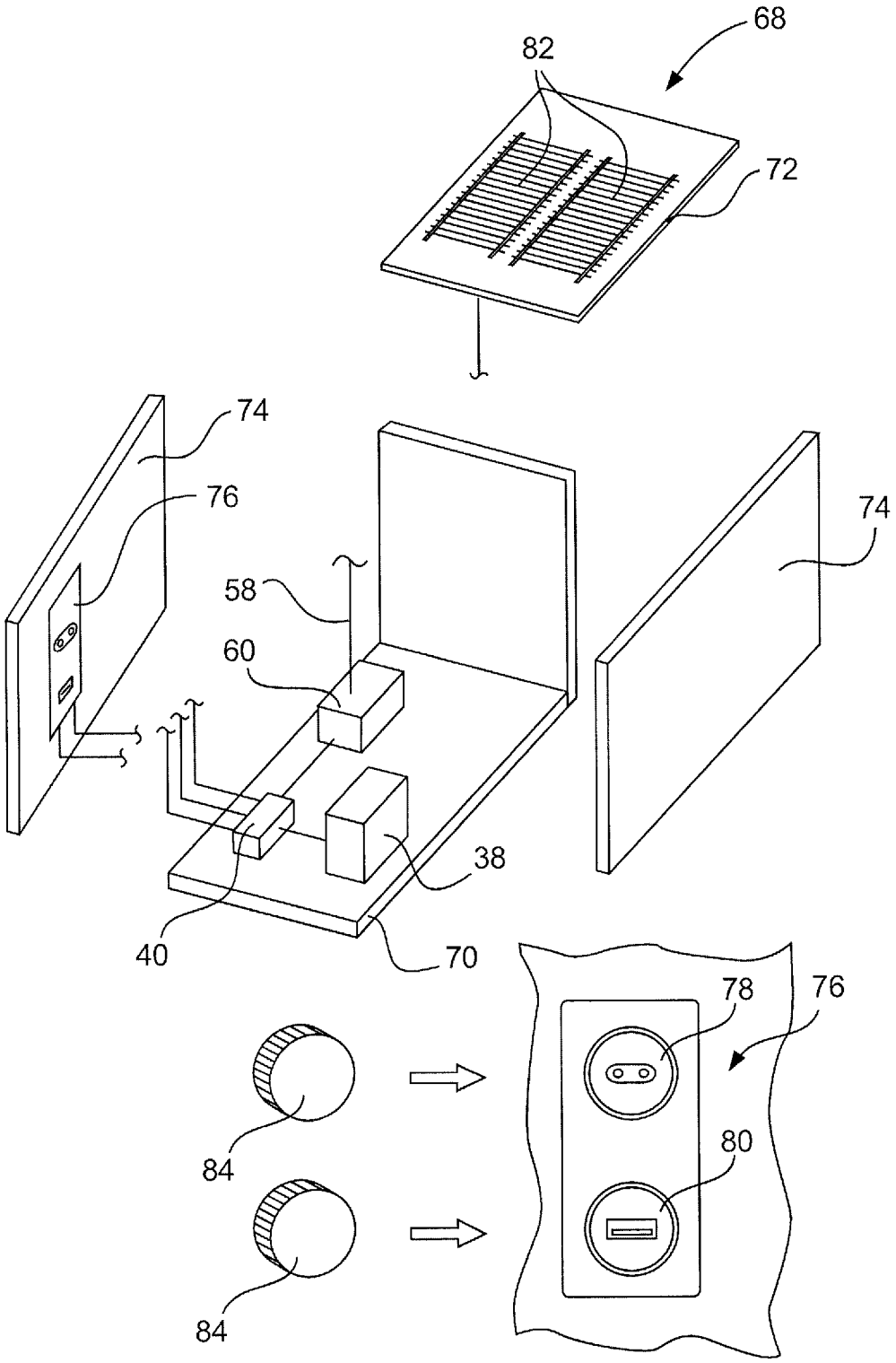
FIG. 3 shows a view of a drive unit according to the invention for use in a lounger according to the invention.

The drive unit 68 is shown in more detail in FIG. 3. The drive unit 68 may for example comprise a base 70 and a top 72, wherein an accumulator 38, an electronics unit 40, and a compressor 60 may be arranged at the base 70. At a lateral surface 74, for example a series of plug sockets 76 may be arranged, which provide manifold connection possibilities. For example, a grid connection 78 may be provided, at which a cable enables the operation of the lounger 2 according to the invention from a public power grid. Equally, this grid connection 78 may also serve for charging the accumulator 38, wherein the electronics unit 40 also functions as a charging electronics. In this way, a fast operation with a strongly discharged accumulator 38 may be made possible, for example after a longer operation pause of the lounger 2 according to the invention. Furthermore, a connection 80, for example for small electronic devices which may be used at the lounger 2 according to the invention, may be also provided. Exemplarily, this connection 80 for small devices is shown as an USB connection, as nowadays lot of mobile electronic devices may be supplied with electricity by way of such a connection. Here, the electronics unit 40 functions as a voltage converter, which provides a constant voltage of 5 Volt to this connection

80, and at the same time limits the current to 0.5 Ampere or to another, predefined common maximal value.

As the lounger 2 according to the invention may mainly be used during good weather, it may be appropriate to arrange one or several solar cells 82 at the top 72, which solar cells are also to be connected to the electronics unit 40. In this way, it may be ensured that the lounger 2 according to the invention may always be ready for use, as the accumulator 38 may also be charged by the operation of the solar cells 82. In such a structure of the drive unit 68, the electronics unit 40 functions as a voltage converter which converts the voltage provided by the solar cells 82 into a charging voltage. The electronics unit 40 should furthermore be adapted for maintaining the accumulator 38, that is to say, it is to be made sure that the accumulator 38 may neither be overcharged nor be discharged too deeply.

The provided plug sockets 78 and 80, or all further possible connection sockets may be arranged in a recess of the housing for protection against weather influences or against saltwater, which recess of the housing may be provided with a thread which respectively allows a screwed connection with a screw cap 84.

At this point it should be noted, that the shown embodiments in FIGS. 1-3 only serve for illustration purposes, the invention is in no way confined to the shown embodiments. This applies in particular to the dividing of the lounger frame into five lounger frame areas, also more or less areas may be possible. Substantially, in the design of such loungers, at least a one pivotable backrest and preferably also an adjustable foot part are to be provided. The configuration of the drive unit according to the invention is also not limited to being arranged in a receiving compartment below the foot end, or to being placed on a base beside the foot part. In fact, there may be no limits to the creative freedom of the person skilled in the art, however, at the time of the application it appeared that the shown positions and arrangements may be quite advantageous. Furthermore, the invention is not limited to using certain kinds of drive devices. All drive devices may be possible which are capable of performing a linear and/or rotational movement. Besides spindle drives with electro-motors, pneumatic and hydraulic drives may be used, wherein a pneumatic drive in the form of a pneumatic cylinder may be coupled to the compressor for an air mattress. In this way, a very variable design of the drive may be possible, as within the lounger according to the invention, only pressurized air has to be transferred.

Additionally, it should be noted, that "comprising" does not exclude other elements or steps, and that "a" or "an" does not exclude a plurality. Furthermore, it should be noted that features described with reference to one of the embodiments above may be used also in combination with other features of other embodiments described above. Reference signs in the claims should not be construed as limitations.

REFERENCE SIGNS

2 lounger
4 base frame
6 lounger frame
8 drive unit
10 receiving compartment
12 area of the lounger frame
14 area of the lounger frame
16 area of the lounger frame
18 area of the lounger frame
20 area of the lounger frame
22 lounger overlay
24 lever
26 drive device
28 point
30 slot
32 dashed line
34 drive device
36 point
38 accumulator
40 electronics unit
42 remote control
44 area of the lounger overlay
46 area of the lounger overlay
48 area of the lounger overlay
50 area of the lounger overlay
52 area of the lounger overlay
54 airtight casing
56 pressurized air connection
58 pressurized air line
60 compressor
62 wheel
64 foot
66 handle
68 drive unit
70 base
72 top
74 lateral surface
76 plug socket
78 grid connection
80 connection for small devices
82 solar cell
84 screw cap

The invention claimed is:

1. A lounger, comprising:

at least one weatherproof base frame adapted for receiving a lounger frame;

at least one weatherproof lounger frame adapted for being arranged on the base frame, the lounger frame including at least two movably mounted longer frame elements;

a weatherproof receiving compartment connected to the base frame, at least one induction coil situated within the receiving compartment;

at least one drive device moving at least one of the lounger frame elements, the drive device situated within the receiving compartment;

at least one weatherproof drive unit providing electric energy, the drive unit being connected to the at least one drive device; and an electrical connection device including at least one induction coil situated in the drive unit, wherein the drive unit is encapsulated and is adapted for being electrically connected to the lounger.

2. The lounger according to claim 1, wherein the drive unit includes at least one accumulator; at least one grid connection; and at least one electronics unit which is adapted for delivering electric energy from the accumulator via the electronics unit to the at least one drive device, and which is adapted for transforming a voltage applied at the grid connection into a charging voltage for the accumulator.

3. The lounger according to claim 2, wherein the electronics unit is adapted for delivering electric energy to the at least one drive device and wherein the delivering of electric energy is controlled by a control unit.

4. The lounger according to claim 2, wherein the drive unit further includes at least one solar cell which is connected to the electronics unit and wherein the electronics unit is adapted for transforming a voltage of the solar cell into a charging voltage for the accumulator.

5. The lounger according to claim 1, wherein the drive device is encapsulated for protection against environmental effects.

6. The lounger according to claim 1, further comprising:

a lounger overlay with an upper side and lateral surfaces made of a water-repellent material and a breathable lower side.

7. The lounger according to claim 1, wherein the drive unit further includes at least one compressor.

8. The lounger according to claim 7, further comprising:

a pressure-tight lounger overlay connected to the compressor.

9. The lounger according to claim 1, wherein the receiving compartment receives the drive unit.

10. The lounger according to claim 1, wherein the drive unit includes a small device connection operating external electronic devices.

11. The lounger according to claim 1, further comprising:

at least one small device connection in a recess, the recess being closable by a cap.

12. The lounger according to claim 1, further comprising:

at least one grid connection in a recess, the recess being closable by a cap.

13. The lounger according to claim 1, wherein the lounger is designed for use on a ship and wherein the base frame includes a salt-water-proof priming and/or finishing.

14. The lounger according to claim 13, further comprising:

a slip-proof coating at areas which contact a floor of the ship.

15. A drive unit adapted for being arranged at a lounger, comprising:

at least one accumulator;

at least one electronics unit;

at least one grid connection;

at least one weatherproof receiving compartment including at least one induction coil, the receiving compartment connected to the lounger;

at least one induction coil corresponding to an induction coil situated in the receiving Compartment;

at least one drive device situated within the receiving compartment;

wherein the electronics unit is adapted (a) for transforming a voltage applied at the grid connection into a charging voltage for the accumulator and (b) for delivering, controlled by a control unit, an electric voltage to at least one drive device of the lounger and wherein the drive unit is encapsulated and adapted for being electrically connected to the lounger.

16. The drive unit according to claim 15, further comprising:

at least one solar cell, wherein the electronics unit is adapted for transforming a voltage applied at the solar cell into a charging voltage for the accumulator.

17. The drive unit according to claim 15, wherein the drive unit is designed for use on a ship and wherein the drive unit is adapted for supplying energy to a plurality of further driving devices of further loungers.

* * * * *